United States Patent [19]

Hawkinson

[11] 4,220,081

[45] Sep. 2, 1980

[54] SHEET FEEDING, REGISTERING AND PRINTING APPARATUS

[75] Inventor: Warren S. Hawkinson, St. Paul, Minn.

[73] Assignee: Deluxe Check Printers, Inc., St. Paul, Minn.

[21] Appl. No.: 876,059

[22] Filed: Feb. 8, 1978

[51] Int. Cl.[3] ..... B41F 1/28; B41J 13/08; B41J 13/28

[52] U.S. Cl. ..... 101/93.11; 101/93.28; 101/287; 271/243; 271/205

[58] Field of Search ..... 101/232–243, 101/272–279, 55, 107, 196, 408, 413–415, 93.11, 90, 93.12, 93.18, 93.28, 287, 193; 400/622–623, 629, 635, 624; 271/37, 69, 109, 243–247, 198, 205

[56] References Cited

U.S. PATENT DOCUMENTS

| | | | |
|---|---|---|---|
| 1,908,921 | 5/1933 | Rosenthal | 101/193 |
| 2,208,044 | 7/1940 | Ormond | 271/246 |
| 2,812,940 | 11/1957 | Kes, Jr. | 271/235 |
| 3,194,157 | 7/1965 | McKeag | 101/196 X |
| 3,814,014 | 6/1974 | Dahlgren | 101/408 |

*Primary Examiner*—J. Reed Fisher

*Attorney, Agent, or Firm*—Dorsey, Windhorst, Hannaford, Whitney & Halladay

[57] ABSTRACT

A sheet feeding, registering and printing apparatus has one or more printing units for printing desired characters on a sheet, and means for feeding such a sheet positively to and from a printing position with respect to each printing unit. The feeding means includes a feed band having gripping devices for gripping engagement with each sheet to hold the sheet in a predetermined position on the band, with no longitudinal slippage. The band is driven intermittently in equal incremental movements to and beyond the printing position. The apparatus includes initial sheet supply mechanism for feeding successive sheets to the band, and registration means for sequentially positioning a leading edge of each sheet in accurate registration with the band and for engaging the gripping devices with the sheet before the sheet is moved intermittently to the printing position.

24 Claims, 11 Drawing Figures

SHEET FEEDING, REGISTERING AND PRINTING APPARATUS

FIELD OF THE INVENTION

The invention involves the field of sheet feeding, registering and printing apparatus, and more particularly apparatus having a printing unit for printing desired characters on a sheet, and means for feeding such a sheet to and from a printing position with respect to the printing unit. The invention specifically involves the printing of desired characters or legends on partially preprinted sheets which include a plurality of individual bank checks or other documents of this type in which additional information is needed on each individual check area, such as the name of the checking customer, the magnetic ink coding for a particular customer account and the successive serial numbers for individual checks.

DESCRIPTION OF THE PRIOR ART

In the printing of checks and related banking or accounting forms for assembly into checkbooks or the like, methods have been used in which a batch of sheets can be preprinted with certain common material in such a way that a plurality of individual check blanks are preprinted on each individual sheet. In bank checks, for example, one can preprint the usual forms for the date line, payee, amount, signature line, etc. A batch of such partially preprinted sheets can then be fed to a suitable printing unit or press, in which one sheet at a time has been moved into printing position, and all check areas on the sheet can then be printed with data which is not common for all customers, for example, the customer name, the magnetic ink codes (MICR) for that particular customer's bank, the serial numbers for the individual customer checks, and the like. Such a process may utilize a flat bed or other type of printing press and the process is a sort of batch process in which the entire area of each preprinted sheet is further printed with the desired characters and legends for all of the individual check blanks on that sheet.

It has also been proposed to feed such sheets by continuously moving slip belts along a path passing through a printing position, and stop the sheet by physical engagement of its leading edge against vertically movable stop members at the printing position. Such stop members have been spaced in such a way as to stop the sheet successively as each individual check area of such a sheet arrives at the printing position. Thus the additional desired characters or legend were to be added at the first stop for a first check or first row of checks on such a sheet, and the sheet was then moved against a second stop where another check or row of checks was to be suitably printed.

In such apparatus, however, the successive stops, when moved up into stopping position, must arrest the forward movement of the sheet against the continuous feeding forces of the continuously moving feed belts. Thus the feed belts must permit substantial relative slipping between the belts and the sheets in order to avoid buckling of the sheet or substantial damage to the sheet edge which strikes each stop. In addition to the possibility of physical damage at each impact of the sheet against the stop, the slip feed may limit the speed and accuracy of movement of the sheet from one position to the next, as a first stop is retracted and another later stop is held in sheet stopping position. The continuous slip feed arrangement is thus subject to possible inaccuracies of registration at the printing station, if the sheet does not positively reach the stop, or if it rebounds from the stop or if it is partially buckled at a location between the stop and the actual area of the sheet which is to be printed at that position. A prior art machine of this type is shown in U.S. Pat. No. 2,812,940.

High-speed printing units are presently known, in which printed legends or characters can be applied successively at successive areas of a continuous web or sheet. Such printers have been used to print the output data from a suitably programmed data processing machine. Such printers have also been used for other printing operations, for example, in the printing of predetermined data on such a continuous sheet under the control of a computer or minicomputer into which the operator can feed certain desired information, store such information, and provide appropriate controls or signals for the printout of selected portions of such data.

SUMMARY OF THE INVENTION

The prescnt invention provides an improved sheet feeding, registering and printing apparatus for feeding individual sheets to a printing position with respect to a bed and platen printing unit which is adapted to print desired characters on a sheet and for moving the printed sheets beyond the printing position to a discharge point. The apparatus includes a feed band having at least one gripper device thereon for positive driving engagement with each such sheet, in combination with intermittent driving means for positively driving the feed band in equal incremental movements to and beyond the printing position, an initial sheet supply mechanism for feeding successive sheets to the feed band and gripping device, and registration means for sequentially positioning a leading edge of each sheet in accurate registration with the feed band and gripper device before the sheet is moved intermittently to the printing position.

In a preferred specific sense, the invention provides such apparatus in which the relative length of each sheet along the direction of feed is at least equal to the total length of a specified plurality of incremental movements of the feed band. The apparatus is particularly designed for the further or final printing of sheets on which a plurality of bank checks or the like have been partially preprinted with common legends or information in a plurality of equal rows extending transversely across the sheet with respect to the direction of feed of the apparatus, and in which the length of each incremental movement of the feed band is equal to the distance covered longitudinally of the sheet by each such transverse row or blank. Thus, the individual check or blanks in each row will be successively printed at the printing position as the intermittently driven feed band stops in a dwell position at the end of each such incremental movement.

In this preferred application, the total size or length of the sheet along the direction of feeding movement is preferably equal to an exact multiple of the widths of the individual check blanks or rows, and the initial sheet supply mechanism and the registration means include relative timing and driving means for sequentially positioning the leading edge of each sheet in accurate registration with the trailing edge of the immediately preceding sheet. Thus the successive sheets are held in positive driving engagement with the feed band and moved intermittently to and beyond the printing position, just as if the individual sheets were part of one long continuous sheet on which the individual check blanks or forms were preprinted at exact intervals and could be accurately registered at the printing station without the prior art problems of accurately feeding and registering separate individual sheets.

The invention further provides apparatus in which the feed band extends longitudinally through the printing position in a continuous loop around an intermittent driving roller or sprocket, which supports one end of the feed band at a registration position ahead of the printing position, and an idler drum or sprocket supported for rotation on a transverse axis beyond the printing position, in which the feed band and driving drum have interengaging means providing positive nonslipping driving engagement between them, in which the circumference of the driving drum is exactly equal to a selected whole number of lengths of the individual sheets to be printed, and in which the registration means includes at least one radially projecting registration stop fixed to rotate intermittently in synchronism with the driving drum and projecting upwardly above the feed band for engagement by a leading edge portion of a sheet fed from the initial sheet supply mechanism as the intermittent drive comes momentarily to rest between incremental movements, the number of such radial registration stops around their axis of rotation corresponding to the selected whole number of sheet lengths around the circumference of the driving drum. The invention specifically provides one gripper assembly secured on the feed band at a location corresponding to each such registration stop, and the gripper assembly includes a gripper member above the band, which is resiliently biased to normally engage and hold the sheet edge, the stripper assembly having a cam follower portion movable to open the gripper against its resilient bias, and cam means in the apparatus for momentarily engaging the gripper cam follower and opening the gripper as the leading edge of a sheet is fed toward and against the registration stop. The cam means releases the gripper so that it firmly clamps the sheet along the feed band during the moment of dwell and then carries the sheet in positive driving engagement with the band throughout the following intermittent feeding movements of the band.

The invention further contemplates the provision of two feed bands, one at each lateral edge of the sheet being fed, with corresponding driving drums, registration stops and gripper assemblies, but with one feed band serving as a control guide for proper registration of its edge of each sheet during the passage to and beyond the printing position, and with the other feed band at the opposite edge of each sheet supported for movement along a longitudinal path diverging slightly away from the band at the registration edge of the sheet. The respective gripping assemblies on the two bands each provide for positive nonslipping engagement between the sheet and band in a longitudinal direction. The grippers on the registration-controlling edge of the sheet are further provided with longitudinal sheet engaging edges or other means to prevent lateral slipping movement of the sheet away from the registration band and toward the opposite band. The grippers on the opposite band, however, have laterally-smooth sheet-engaging surfaces which permit limited lateral slipping of the gripper with respect to the sheet as the gripper follows its diverging path with respect to the grippers at the registration edge of the sheet. Thus the grippers at this opposite edge provide a slight lateral tensioning of each sheet, to be sure that it is held absolutely flat as it is moved to the printing position, while it is momentarily stationary at the printing position, and as it moves beyond the printing position to a discharge location.

Other features, details of construction and advantages of the present invention will be apparent from the following detailed description of the preferred embodiment and from the claims which form a part of this application.

BRIEF DESCRIPTION OF THE DRAWINGS

In the drawings which form a part of this application and in which like reference numerals indicate like parts.

DESCRIPTION OF THE PREFERRED EMBODIMENT

General Description and Operation

Figures 1, 1A:
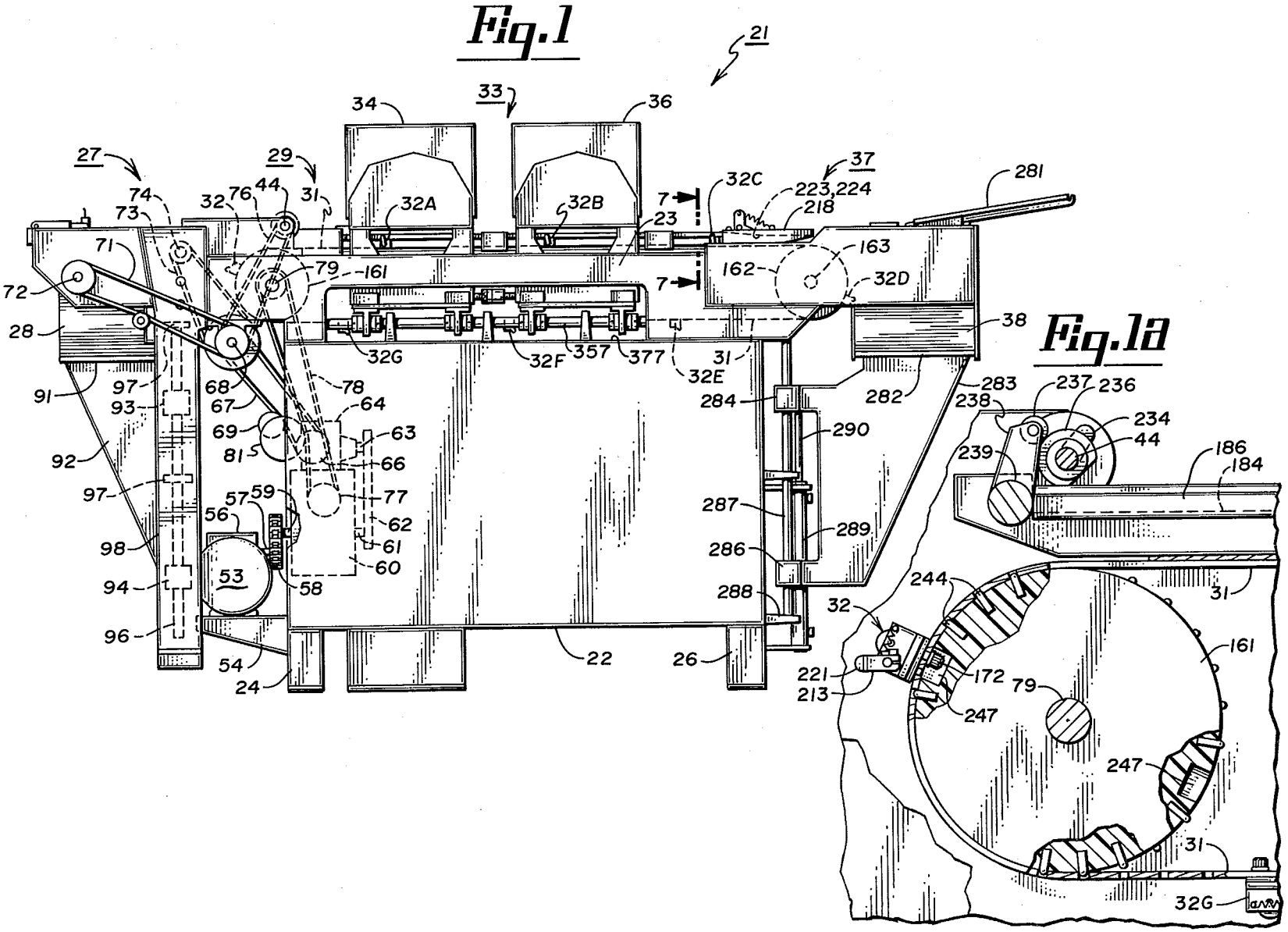
FIG. 1 is a side elevation of a sheet feeding, registering and printing apparatus according to the invention.
FIG. 1A is an enlarged partial view corresponding to part of the area in FIG. 1, showing details of the driving connection between the intermittent driving drum and feed band of the apparatus.
Figures 2, 4, 5, 6, 7:
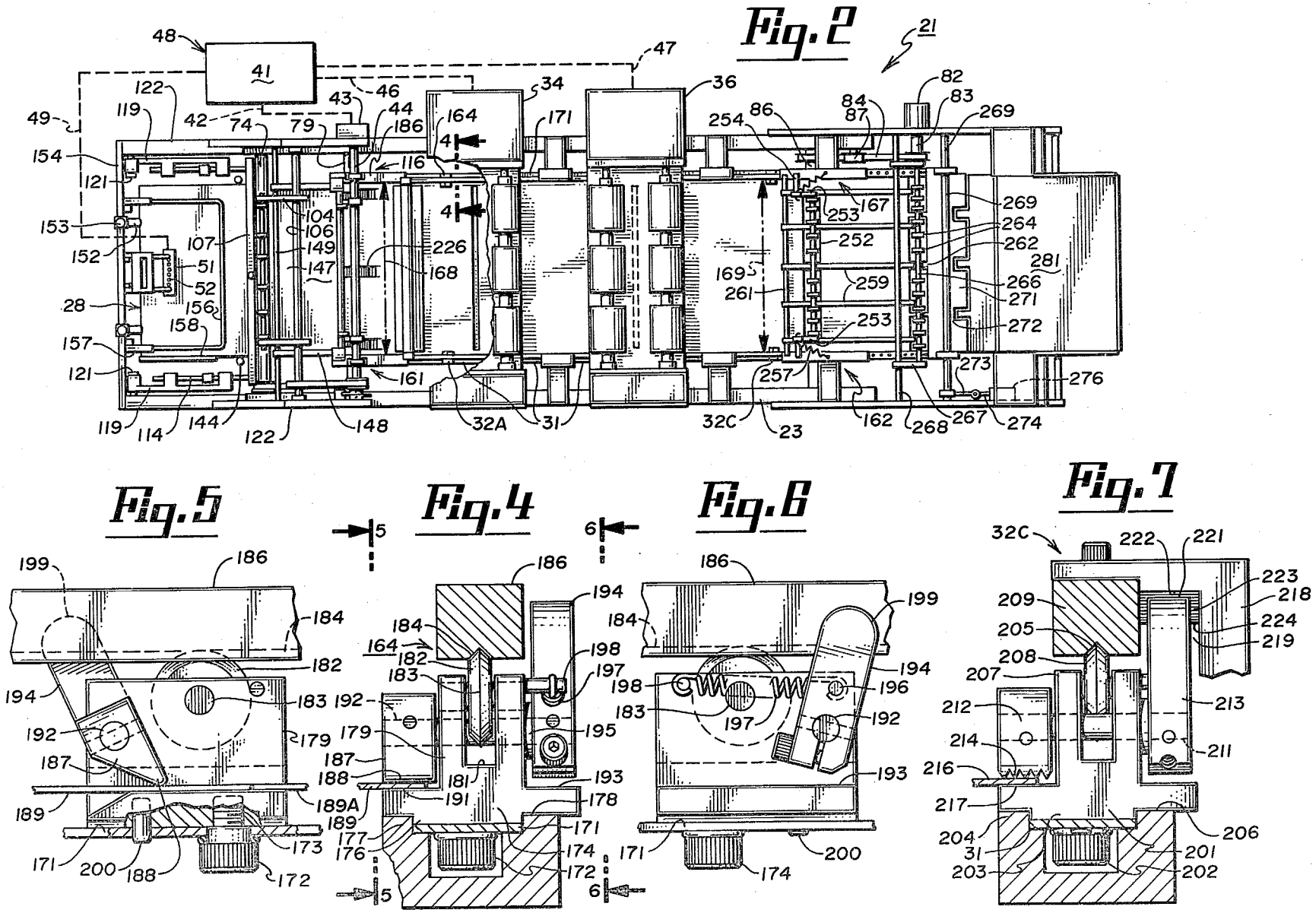
FIG. 2 is a plan view of the apparatus of FIG. 1.
FIG. 4 is an enlarged sectional view on the line 4—4 of FIG. 2, showing details of one of the sheet gripping and feeding members of the invention.
FIG. 5 is a view on the line 5—5 of the gripping mechanism of FIG. 4.
FIG. 6 is a view on the line 6—6 of FIG. 4 showing further details of the gripping mechanism.
FIG. 7 is a view similar to FIG. 4, taken on the line 7—7 of FIG. 1, showing details of the gripping mechanism at the registering edge of the machine and of the cam track for releasing such gripper at the end of its run.

As shown generally in FIGS. 1 and 2, the sheet feeding, registering and printing apparatus 21 includes an initial sheet supply mechanism indicated generally at 27, at which the top sheet from a supply stack 28 is fed from the stack toward a sheet registering and feeding mechanism indicated generally at 29. At this point, each individual sheet is picked up in proper register by feed bands at each lateral edge. One such band is shown at 31 and carries gripping members 32 which hold the sheet in proper position longitudinally of band 31, while the band feeds the sheet through the printing section 33 of the machine. In the printing section one or more printing units, two of which are shown at 34, 36, are operated to apply the desired printed characters to each sheet. The movement of the bands and sheets through the printing section is intermittent, the printing takes place during moments of dwell at which the sheets are held stationary at the printing units 34 and 36, and the longitudinal movement of the sheets between the periods of dwell is just sufficient to bring a desired new area beneath each printing unit to receive the required printed legend before the next intermittent movement. In the case of blanks for printed bank checks, one convenient blank size has a dimension of twelve inches longitudinally of the machine and thus provides areas for four three-inch strips, which can then extend laterally across the sheet for a lateral total width adequate to accommodate one or more, and preferably at least two, individual check areas, depending on the width of the machine and the size of checks to be printed, as well as the capacities of the printing units 34 and 36.

In such a typical case, the intermittent movement of feed band 31 will be precisely three inches from dwell to dwell, and a single check strip (with the designed number of checks extending laterally across the blank beneath each printing head) will then be printed at each dwell. In this case, a single sheet will move intermittently past each printing head with a moment of dwell for each of the three strips.

After the sheets have been printed they are fed into a discharging section of the machine at 37 and accumulated at the top of a stack 38 on a suitable discharge table or receptacle.

As shown in FIG. 2, the operation of the printing units 34, 36 may be controlled by a suitable computer or minicomputer 41, which in turn receives timing signals through a connection 42 with a timing encoder 43 on one of the intermittently driven shafts 79 of the sheet feeding mechanism. The computer or other control device is suitably connected at 46 to one printing unit 34 and also connected at 47 to the other printing unit 36. In this particular embodiment, the timing encoder includes known mechanism for providing as many as 2,540 signal pulses per revolution of shaft 79, and any of these individual pulses can be preselected so that control device or computer 41 can be triggered at any desired point. One such encoder is commercially available from Encoder Products.

Suitable control information to determine the information to be printed on each set of blanks for a particular checking account or customer can be introduced to the control computer 41 as shown schematically at 48, in known manner. The computer 41 also has a connection at 49 to a suitable parity check device 51, which includes a desired number of light-sensitive cells 52. The cells provide appropriate signals for computer 41 based on the presence or absence of a suitable parity code, such as a set of one or more marks, on the first or control sheet (or any so-marked sheets) of a particular set of sheets which are to be printed or further printed by the present apparatus. Thus the combination of the parity checking device 51, the timing device 43 and the appropriate input at 48 to computer 41 insures the printing of the desired characters or legends for a particular sheet or batch of sheets, as these sheets pass through the printing mechanism section 33, and the legends can be appropriately changed and other information printed for each successive sheet or batch of sheets, after the desired number of sheets in a first batch have been printed for one customer or purpose and the next batch is to be printed in a different manner for another customer or purpose.

Driving Mechanism

The driving mechanism for the apparatus includes a first electric motor or prime mover 53 (FIG. 1) mounted on a supporting bracket 54 of the frame. Motor 53 has its shaft connected to a worm gear transmission 56, with an output shaft 57. A chain drive 58 connects shaft 57 to the input shaft 59 of a special gearbox 60. Gearbox 60 has a continuously rotating output shaft 61, which may be an extension of input shaft 59, if no change in gear ratio is desired at this point. Shaft 61 is further connected by a positive drive belt 62 to the input shaft 63 of a right angle drive unit 64 at the top of gear box 60. Positive drive belt 62 is of known construction and includes inwardly projecting "teeth" which engage corresponding driving and driven recesses in the corresponding pulleys or sprockets on shafts 61 and 63. Such positive drive belts are used throughout major portions of the driving mechanism of this device to insure a positive driving connection with no relative slippage, as the appropriate driving ratios are achieved from one shaft to another. From the right angle drive mechanism 64, a continuously rotating output member 66 is connected by positive drive belt 67 to the main continuous driving shaft 68 of the sheet supply and feeding portions of the apparatus. An idler 69 engages the belt 67 for desired tension.

From continuously driven main shaft 68, a further positive drive belt 71 drives the camshaft 72 of the initial sheet supply mechanism.

A further positive drive belt 73 connects main shaft 68 with a continuously rotating in-feed roller shaft 74, to which sheets are fed from stack 28 in a manner to be described.

Main shaft 68 is connected by another positive drive belt 76 to driven shaft 44. Shaft 44 serves as a camshaft for controlling certain operations of the sheet gripping mechanism as hereinafter described.

To achieve the desired intermittent drive of the feeding bands, such as 31, the special gearbox 60 includes an intermittent output drive 77, connected by another positive drive belt 78 to the main intermittent driving shaft 79 for the feed bands, which is also connected to the timing mechanism or encoder 43 previously described. An idler 81 also engages the belt 78 to maintain the desired tension. Special gearboxes suitable for receiving a continuous driving input and providing an intermittent output at 77 are well known. One such indexer mechanism is comcially available from Ferguson Machine Co.

Figure 8:
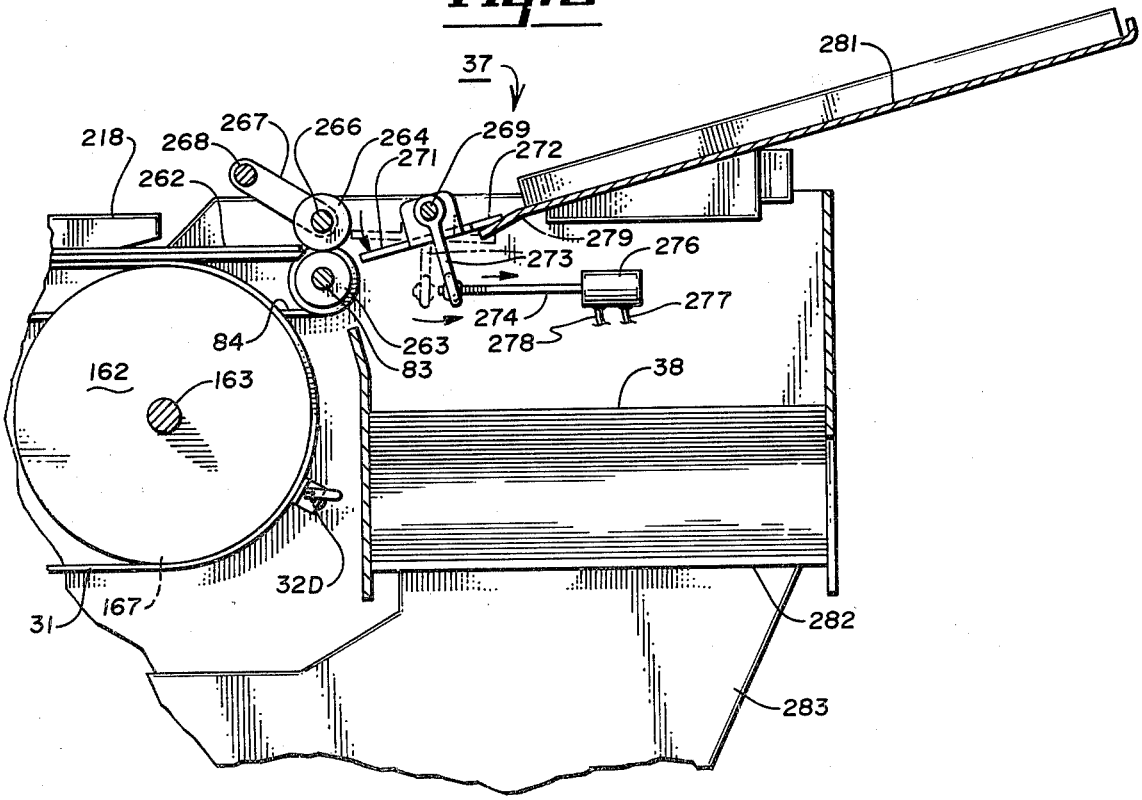
FIG. 8 is an enlarged partial elevation, with certain portions broken away and others shown in section, illustrating details of the sheet discharging mechanism at the end of the machine.
Figure 9:
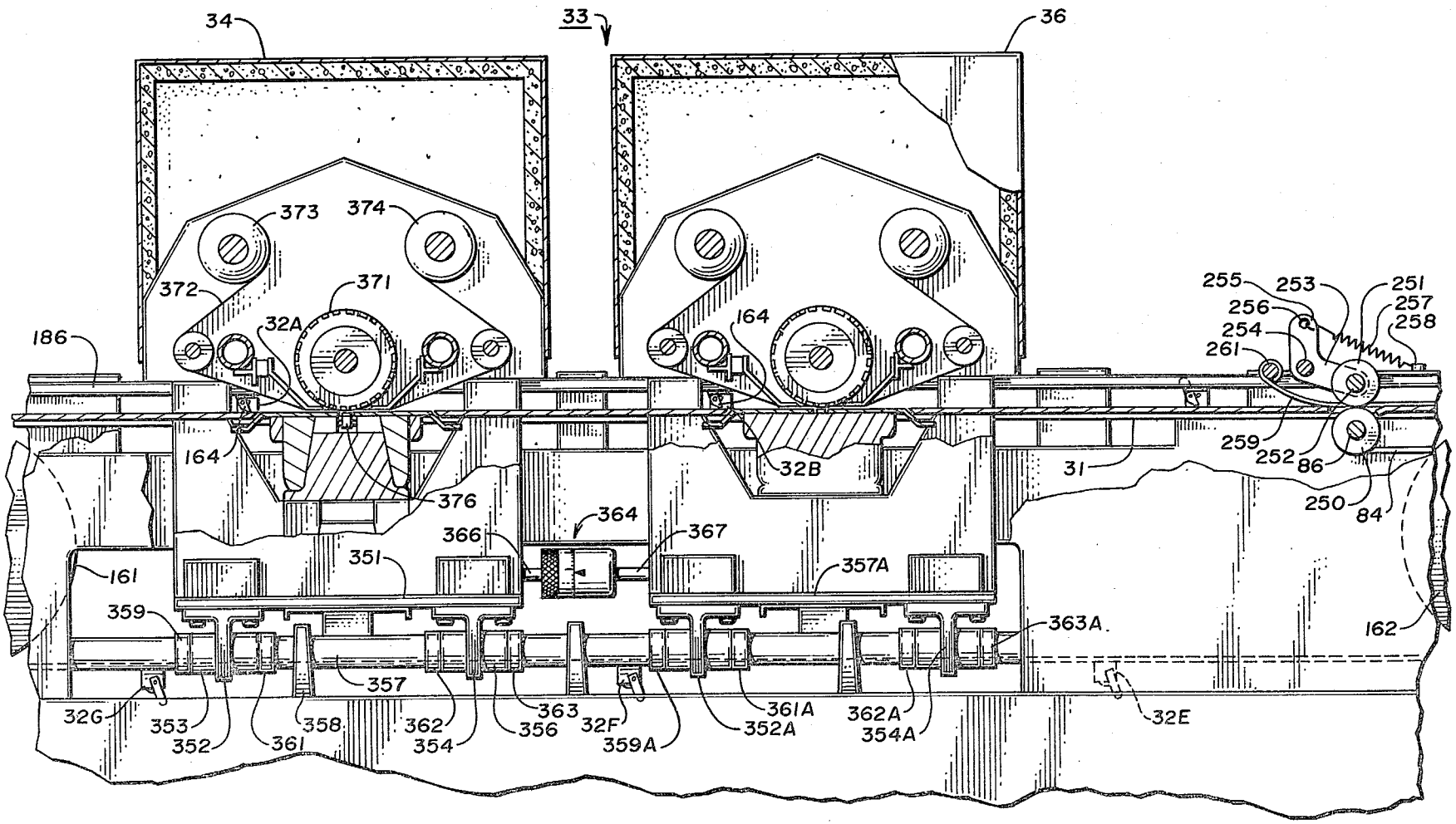
FIG. 9 is an enlarged partial elevation similar to FIG. 1 showing features of the printing mechanism and its support.

The driving mechanism for the sheet discharging section of the apparatus includes a second driving motor 82 (FIG. 2) interconnected to drive a cross shaft 83 (FIGS. 2 and 8) continuously. Discharge shaft 83 is further connected by a positive drive belt 84 to a second transverse discharge shaft 86 (FIGS. 2 and 9). An idler 87 provides the desired tension in belt 84. Shafts 83 and 86 are provided with suitable discharge feed rollers which operate in a manner hereinafter described.

The described driving mechanism thus provides for intermittent rotation of shaft 79 (FIG. 1) for intermittent movement of the feed bands and desired shafts through the printing heads 34 and 36. At the same time, the initial sheet supply mechanism and the sheet discharging mechanism can operate continuously from the respective main driving shaft 68 and the discharge shafts 83 and 86.

Initial Sheet Supply Mechanism

Figure 3:
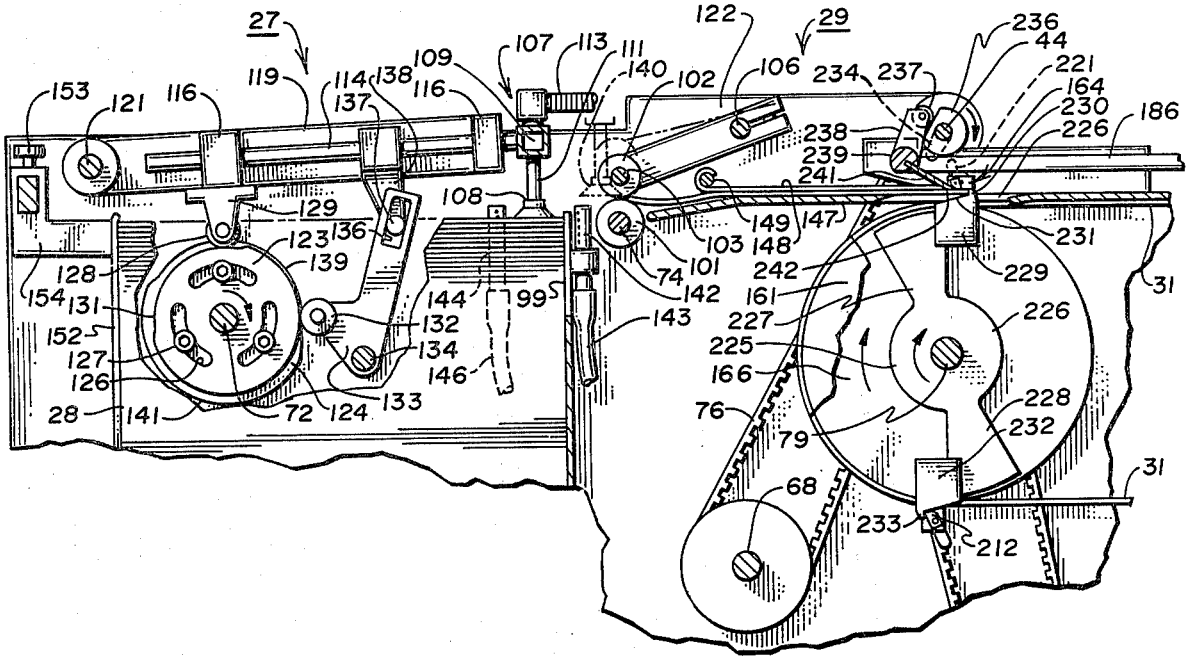
FIG. 3 is an enlarged partial elevation, with certain portions broken away, showing the initial sheet supply mechanism and part of the registering mechanism of the invention.

As shown particularly in FIGS. 1, 2 and 3, the initial sheet supply mechanism includes the supporting table or receptacle 91 for the supply stack 28 of sheets to be processed in this machine. Supporting shelf or plate 91 is connected by suitable brackets 92 to supporting crossbars 93 and 94 which can slide vertically on supporting posts 96 at each side of the machine. Posts 96 are carried by brackets 97 on vertical frame members 98.

The position of the leading edges of the sheets and stack 28 is determined by a vertical forward guide plate 99 (FIG. 3) and the initial sheet supply mechanism includes transfer means designed to lift the top sheet from the stack and move it in a feeding direction so that the leading edge is caught, in proper timed sequence, between the driven feed roller 101 on continuously rotating shaft 74 and the gripping roller 102. Roller 102 is carried by a vertically spaced cross shaft 103 at the ends of brackets 104 pivoted at shaft 106 to appropriate side frame members 122.

To provide the desired transfer movement of successive top sheets from stack 28, a suction mechanism or head 107 is provided with a lateral row of suction cups 108 carried by a crossbar manifold 109. Suction cups 108 are connected through their tubular support portion 111 to manifold 109 to which a vacuum connection 113 is connected. The suction may be applied and discontinued at appropriate points in the timing cycle of the machine as hereinafter described. The suction head 107 is supported for movement both vertically and longitudinally. For this purpose the crossbar manifold 109 is carried at the forward ends of longitudinally extending support rods 114. Rods 114 are mounted for longitudinally sliding movement in brackets 116 of a longitudinally extending support arm 119, which is pivoted on shafts 121 at a suitable point on the side frame members 122.

Thus the vertical and longitudinal position of the suction head 107 can be controlled by appropriate relative longitudinal movement of supporting rods 114 and by appropriate corresponding vertical rocking movement of support arm 119. These desired feeding movements are controlled by two cams 123 and 124 which are mounted for continuous rotation on the previously described camshafts 72 at either side of the supply stack 28.

The rotary positions of the cams 123 and 124 on either side of stack 28 may be adjusted relative to shafts 72, in order to adjust the relative timing positions at which the cams become effective. The cams are also removable in case a different cam pattern is desired. For these purposes, cam 123 is illustrated with arcuate slots 126, through which securing bolts 127 project and can be tightened to hold the cam in adjusted relative rotary position. For vertical movement of the suction head 107, a cam follower roller 128 is mounted on a bracket 129 on supporting arm 119. Thus when cam 123 is in the position shown in FIG. 3, cam follower 128 engages the lower portion 131 of the cam. Thus the arm 119 will be in its lower position in which suction cups 108 engage the top sheet of stack 28 ready to effectively lift the topmost sheet above the edge of plate 99 when the sheet is then ready to be moved toward the feed roller 101. When the cam 123 rotates so that the higher portion of the cam is engaged by cam follower 128, the arm 119 is lifted to its upper position, and the suction cups 108 will raise the top sheet in the stack.

Similarly, when cam follower 132 engages the lower portion 139 of cam 124, as shown in FIG. 3, the cam follower 132 and its pivoted bell crank lever 133 can move around the pivot 134 to the position shown in FIG. 3. A slot 136 at the upper end of the bell crank 133 engages a pin or a follower 137 in a bracket portion 138 extending downwardly and fixed to the longitudinal sliding support arm 114. The slot 136 permits straight-line sliding movement of support rods 114 in response to the rocking movement of bell crank 133. Thus the suction head 107 can move to the left-hand or rearward position as shown in FIG. 3 at the low area 139 of cam 124. When the raised portion 141 of cam 124 moves into position for engagement by cam follower 132, the bell crank 133 will rotate in a clockwise direction as viewed in FIG. 3 to move the suction head 107 toward feed roller 101, i.e., to the phantom line position shown at 140. At this point the front edge of the top sheet will be fed between feed roller 101 and gripping roller 102.

Thus, by suitable selection of the respective cam patterns 123, 124 and of their relative rotary positions on shaft 72, the desired feeding movement of suction head 107 can be obtained. The movement is coordinated with the application of suction at suction cups 108, so that the top sheet can be lifted and moved to the right toward the feed roller 101, as the suction cups move from the solid line position of FIG. 3 to the phantom line position 140.

An air separating mechanism blows continuously in order to prevent the inadvertent lifting of more than the single top sheet. For this purpose a rearwardly directed blower 142 is supplied with air through conduit 143 to blow against the leading edge of the top sheet and thus provide a positive air jet to separate the second sheet, if such second sheet has in fact been lifted by indirect action of the suction from suction cups 108 through the top sheet.

Similarly, side blowers 144 are supplied with air jets through a supply connection 146 to direct a continuous jet of air against the sides of the sheet being lifted from the top of the stack. The combination of the rearward and lateral air jets thus helped to insure the feeding of a single top sheet at a time.

The sheets which are gripped between feed roller 101 and gripping roller 102 are moved toward the sheet registering and intermittent feeding mechanism across a suitable support surface 147. An angular ribbon 148 is inclined forwardly and downwardly to engage the top surface of each edge of the sheet and prevent its leading portion from buckling upwardly as the sheet moves toward the sheet registering and intermittent feeding mechanism. These ribbons or steadying members 148 are carried on a cross member 149 which, in turn, is supported in vertical frame members 98. Each ribbon extends close to the corresponding feed band and gripper to make sure the leading corners of the sheet are held on the support surface and fed smoothly into the grippers.

Other elements of the initial sheet supply mechanism include rear edge guides 152 which are adjustably supported at 153 on a cross frame member 154. Members 152 maintain the rear edges of the sheets in proper position, so that the sheets can be properly engaged by the vacuum transfer mechanism 107. A top retaining member 156 is also provided to engage the top most sheet in the stack, and member 156 is supported at 157 from the frame. This member 156 may either serve solely to prevent the air jets 142 and 144 from accidentally displacing some of the sheets from the top of the stack, or such member may also be used as a position control and may be pivoted in such a way at 157 that it controls the mechanism for raising the supporting table 91 on its vertical support posts 96. For this purpose, the table 91 may be actuated vertically in the same manner to be described in connection with the discharge stack 38.

The lateral alignment of the sheets in the supply stack is established by holding their "right-hand" edges along a side edge guide plate 158. The suction mechanism 107 and rollers 101 and 102 then feed each sheet longitudinally to the feed bands and grippers in a straight path, thus maintaining the established lateral alignment as each sheet reaches the feed band and is clamped in such edge alignment by one of the gripping devices. An intermediate edge guide (not shown) may also be used, if needed or desired, along the same registration line as edge guide 158, at a longitudinal location between rollers 101, 102 and the initial feed band gripping point.

Sheet Registering and Feeding Mechanism

To carry the individual sheets through the printing section 33 of the apparatus, feed bands of longitudinally inextensible material are intermittently driven at each edge of the sheets to be fed, and suitable grippers are carried by these bands to engage each sheet as it is received from the initial supply and feeding section.

The band 31 at the near side of the machine, as viewed in FIGS. 1 and 3, is carried by the driving roller 161 on shaft 79 and by the roller 162 near the discharge end of the machine, which rotates on a shaft 163. Corresponding rollers at the opposite edge of the machine are located at the areas shown by arrows 166 and 167, roller 166 being also carried by intermittent drive shaft 79 and roller 167 being carried by an appropriate shaft section corresponding to shaft 163. These rollers support another feed band 171 (FIG. 4) at that side of the machine.

According to one feature of the invention, the grippers 164 for the left edge of the machine (looking in the direction of feed) are spaced closer together (as shown by the dotted arrow 168) at the start of the intermittent feed path, than at the discharge end of said path. Thus the supporting drums and the bands themselves are oriented in such a way that the spacing indicated by the dotted arrow 169 near the discharge end of the machine is slightly greater than the spacing at arrow 168 (e.g., 0.032 inches at a longitudinal distance of 52 inches. The respective gripping members at the two sides of the machine have slightly different constructional features in order that the grippers 32, 32A and 32B, C, D, E, F, and G, will grip the edges of the sheet at their side of the machine firmly enough to prevent lateral slippage of the sheet away from the band 31 and toward the opposite edge of the machine. The grippers 164 on the band 171 (FIG. 4) at the opposite edge of the machine are designed to insure adequate gripping to move the sheets longitudinally along the path, but such grippers, as hereinafter described with reference to FIGS. 4, 5 and 6, have a bottom surface construction which permits slight lateral slippage. Thus the diverging paths of the two bands are designed to insure the stretching of the individual sheets laterally away from the registration edge and prevent buckling of the sheets in the central area during the printing operation. At the same time, the grippers on band 31 maintain the desired lateral registration of that edge of the sheet throughout the printing operation. Thus the proper positioning of each sheet laterally for the printing operation is insured. The actual details of band 171 at the left edge of the feed path and the details of the driving and supporting drums 166 and 167 for band 171 are at least partially hidden, as viewed in FIG. 2, by other portions of the machine above them.

As shown in FIGS. 4, 5 and 6, however, the band 171 for the left edge of the sheets looking in the direction of feed is provided with gripping members 164 which are secured to the band by connecting members 172 threaded or otherwise secured at 173 within the lower body portion 174 of the support portion of the gripper assembly. This support portion has a central area 176 which projects downwardly to a slight degree to fit between longitudinally extending stationary guides 177 and 178 along the frame to help guide the band and grippers along the desired path. The sides of the gripper support 174 are recessed as shown particularly in FIG. 4 to provide an upstanding central portion 179, with an upwardly opening slot 181 in which a guide wheel 182 is rotatably mounted on a cross shaft 192 extending across the slot 181. Guide roller 182 has a beveled or relatively sharp outer periphery 183 which is designed to engage and be further guided by a V-shaped groove 184 in a longitudinal guide 186 which is also secured to the frame. Thus the path of movement of the body portion 174 of the gripper assembly is carefully defined by both the lower guides 177 and 178 and particularly by the engagement of the beveled guide wheel portion 183 within the guide groove 184 on frame guide member 186.

The gripper assembly 164 further includes a pivoted gripping member 187 which has a lower sheet-engaging tip 188 adapted to be pressed firmly against the top surface of one of the individual sheets 189. Thus the sheet 189 is firmly clamped between the gripping edge 188 and the upper surface 191 at one side of the gripper body portion 174. Gripper member 187 is secured to a gripper cross shaft 192 which extends laterally through the central portion 179 of the support and projects to the recessed area 193 at the opposite side of the assembly. At this location, shaft 192 carries control lever arm 194, which is also securely fixed to shaft 192 so that control arm 194 and gripper member 187 rotate as a unit with shaft 192. A spacing washer 195 is provided. A pin 196 on control arm 194 is engaged by one end of the spring 197, the other end of which is connected to a pin 198 carried by the central body portion 179 at one side of slot 181. This spring 197, as viewed in FIG. 6, urges the control arm 194 in a counterclockwise direction and correspondingly urges gripper member 187 at the other end of shaft 192 in the same rotary direction, which is a clockwise direction as viewed from the opposite side in FIG. 5. Spring 197 accordingly provides the gripping force for engagement of the grip tip 188 against the upper surface of of the sheet shown at 189.

As viewed in FIG. 5, the forwardly and downwardly inclined orientation of the gripper, i.e. the fact that its tip engages the sheet forewardly of the gripper cross shaft along the direction of feed, can further provide a self-tightening action as the gripper cross shaft is accelerated forwardly at each intermittent feed movement.

The gripping engagement can be raised, at appropriate points in the cycle of the machine by engagement of appropriate cam members with the upper end 199 of the control member arm 194.

As shown in FIG. 5, a locating pin 200 is secured to the gripper body and projects through a corresponding recess or opening in the feed band. This maintains proper alignment of the gripper device along the feed band and prevents lateral swinging of the gripper around bolt 173. The pin 200 fits its feed band opening just loosely enough to permit the band to flex away and fit the curvature of the drum.

FIG. 7 shows the details of one cam member for releasing the grippers near the discharge end of the machine. FIG. 7 also shows detail of construction of the grippers at the near edge of the machine as seen in FIG. 1. The basic construction of gripper assembly 32C is essentially the same as that of the gripper assemblies 164 for the opposite side of the machine, except that the arrangement of parts is symmetrical, so that in each case the pivoted gripper member is on the inside of the assembly to engage the corresponding lateral edge of the sheet to be fed, while the control level arms of each such assembly are at the outer sides of the respective gripper assemblies for engagement by appropriate cam members.

Thus in FIG. 7, gripper assembly 32C has a main body portion 201, which is securely connected to intermittent drive band 31 by a connection 202. The lower portion 203 of the supporting body 201 fits between longitudinal guide strips 204 and 206 secured to the frame to provide same guidance for the lower portion of the band and gripper assembly, as shown.

The body portion is recessed at each side and the upstanding central portion 207 carries a guide wheel at 208 similar to wheel 182 of FIG. 4. The periphery of wheel 208 is guided by a corresponding slot 205 in the lower surface of the longitudinal frame member 209, just as in the previous case. In this case the cross shaft 211 carries a pivoted gripper member 212 in the recessed area at the inner side of the assembly. Control arm 213 is carried in the recessed area at the outside of the gripper assembly, and both the gripper and the control arm are secured to cross shaft 211 to rotate as a unit with that shaft.

Gripper 212 differs in one important respect from the previously described gripper 187 at the opposite edge of the feed path. Specifically, the lower sheet engaging edge of gripper 212 is provided with a series of longitudinally extending sharp ridges 214 which can bite into the upper surface of the edge 216 of each sheet being carried by the apparatus to a sufficient degree to insure that sheet 216 will not be moved laterally to the left, as viewed in FIG. 7 by the diverging action of the grippers 164 on the opposite feed band 171. Thus the grippers at the right edge along the direction of feed not only engage individual sheet edges with sufficient firmness to insure their longitudinal movement without relative longitudinal slippage between such sheet edges and the gripper members 32C, etc., but the ridges 214 also maintain and insure proper lateral registration of the edges 216 of the sheets (as originally established by guide edge 158 at the supply stack) while the sheets move along the path at this particular edge, where guiding frame elements 204 and 206 and upper guiding frame 209 thus provide a continuing reference axis which is carefully coordinated in position with respect to the lateral location of the printing units 34 and 36. The grippers 164 at the opposite or left edge of the machine, looking along the direction of feed, will likewise engage the sheets sufficiently to insure the longitudinal movement of those edges of the sheet. But the absence of the longitudinal ridges 214, i.e. the laterally-smooth bottom surface of the gripping edges 188 of the gripper assemblies 164 will let the grippers on that edge move slightly away from the registration edge at the right side of the feed path an thus hold each sheet flat in a lateral direction, without pulling the sheet away from its carefully registered position between the gripping ridges 214 of grippers 212 and the support portion 217 of the gripper support body 201.

As shown particularly in FIGS. 1 and 7, and longitudinal frame guide 209 extends outwardly as shown at 218 to provide an open-bottomed groove or recess 219 between the main body portion 209 and the portion 218, within which the upper end 221 of the control lever 213 can normally pass without interference, due to the spacing between the upper end 221 and the surface 222 at the top of the slot 219. To release the gripper 212 as the sheets reach the end of the intermittent feeding section, the frame member is provided with a downwardly inclined cam surface 223 against which the upper end 221 of the control lever 213 becomes engaged, so that the end 221 is cammed rearwardly toward the viewer in FIG. 7 and thus rocks the shaft 211 and gripper member 212 in a direction to release the gripping edges 214. The relative direction of this releasing rotation would be clockwise, if viewed from the left, and such camming release would involve rotation against the normal urging of a spring member (not shown) corresponding to the spring 197 of FIG. 6.

The inclined cam surface 223 merges into a generally flat exit portion 224, which holds the control arm 213 and gripper 212 in their release position while the sheet is picked up by the continuous discharge driving mechanism to be described. Each gripper then moves around with its band out of the line of feed of the sheets as shown at 32D in FIG. 1 and back along the bottom run of band 31 to the starting point.

The mechanism by which each individual sheet is fed from feed rollers 101 and 102 into proper longitudinal registration with the intermittent drive bands 31 and 171 is particularly illustrated in FIGS. 1, 2 and 3. The main intermittent drive shaft 79 which carries the band drum 161 also carries three sets of registration stops 225, one of which is at the lateral midpoint of the sheet path, and the other two of which are spaced from 1 to 1½ inches inwardly from the grippers at the respective sides of the path. Each set of stops includes two radial registration arms 227 and 228 which are exactly 180 degrees apart. Arm 227 carries a registration member 229 which has a small radially projecting registration stop 230 at the forward edge of a slightly inclined guiding ramp portion 231. A similar assembly 232 is mounted at the outer leading end of registration arm 228 and is provided with a similar registration stop 233. The intermittent motion of shaft 79 is adjusted so that the shaft rotates by steps, e.g. 45 degrees, which can add up to exactly 180 degrees. Thus one stop or the other has one of its momentary rest positions or dwells each time the parts reach a position corresponding to that of FIG. 3. Here such set 225 has its registration stop 230 projecting up through a slot 226 in the sheet-supporting surface in position for engagement by the leading edge of a sheet being fed forwardly by the rollers 101 and 102.

As shown in FIG. 3, the longitudinal spacing between rollers 101 and 102 and the dwell position of registration stops 230 is just slightly less than the length of the individual sheets. Thus, the trailing portion of each sheet 189 is fed ahead by rollers 101 and 102 and buckles slightly up or down (as shown) while the front edge is momentarily held against stops 230 during the dwell period. The intermittent drive provides a high initial acceleration and high velocity for the feed bands during the first part of each intermittent movement, and then moves the band at a slower velocity and decelerates it and brings it to rest at the start of the next momentary dwell. The buckling at the rear of the sheet thus insures full and accurate registration of the leading edge with stops 230. The gripper wheel 102 is then cammed upwardly to an open position by a cam (not shown) to release the drive to the rear end of the sheet, as the front edge of the sheet is registered and gripped by the intermittent feed mechanism. The buckled sheet material then flattens out during the initial acceleration of the next intermittent feed band movement, and may even by briefly underlapped by the leading edge of the following sheet.

The position of the respective registration stops 230 and 233 is closely coordinated with the position of the respective gripping members 32 and 164, so that the leading edge of a sheet which is fed into registering engagement against the stop 230, for example, can be effectively gripped by the corresponding gripper 32. Since each gripper is normally closed or in a gripping position, however, it is necessary to provide a camming release of the gripping member just at the instant when the forward edge of a sheet is being moved into contact with the registration stops. For this purpose, the control shaft 44 carries projecting cam portions 234. The relative timing of the continuous rotation of shaft 44 and the intermittent rotation of shaft 79 is such that one cam 234 will engage the upwardly projecting end 221 of the control arm of gripper 32 and move it rearwardly just long enough to open the gripper slightly before stop 230 reaches its vertical dwell position and let the leading edge of the sheet pass under the open gripper and engage stop 230 while the stop is momentarily at rest. The gripper then closes before the shaft 79 again rotates intermittently. The action of the other cam 234 at the opposite edge of the sheet operates gripper assemblies 164 in the same manner.

Since each projecting stop 230 is relatively small in vertical height, and since the sheets are fed rapidly into position during the moments of dwell, the invention provides a further feature to avoid unintended vertical movement of the leading edge of each sheet in a manner which might let the leading edge pass above stop 230 before the grippers 32 are reengaged. For this purpose, shaft 44 carries a second cam 236 which is engaged by the cam follower 237 on the upper end of a lever arm 238 pivoted at 239 for rotation on a transverse axis.

Rotary cross shaft 239 carries an angularly downwardly and forwardly extending blade member 241 which extends substantially across the three sets of registration stops. The lower forwardly extending edge 242 of blade member 241 is designed to rock downwardly to the registration position shown in FIG. 3 when a low point of cam 236 is engaged by cam follower 237. The timing position of cam 236 is such that blade 241 is rocked downwardly to a point where its edge 242 is low enough to prevent an incoming sheet from overrunning or jumping upwardly above the stops 230. Cam 236 then rocks lever 238 and blade 241 to retracted position so that edge 242 is lifted out of the way of the next incoming stops and out of any undesired contact with the sheet just as the leading edge of the sheet has reached the stops 230 and been engaged by the reclosing of grippers 32 and 164 after they are momentarily opened by cam 234.

In the preferred operating embodiment shown herein, shaft 79 is intermittently driven 45 degrees between each momentary dwell. The circumferential distance between stops 230 and 233 is determined by the radius at each stop, and in this case the radius is designed to provide a total of twelve inches of travel, i.e. three inches between each momentary period of dwell, to accommodate the printing of blank sheets which carry individual printing areas, each of which extends longitudinally a distance of three inches. For precision printing of check blanks, the driving motor, indexing gear box and driving connections to the feed bands can index the feed bands and sheets at a rate in the range of 340 of such three-inch intermittent movements per minute. It should be emphasized that all of the driving connections from the motor 53 to the main continuous drive shaft 68 and its satellite driven shafts, as well as all connections from the intermittent output member 77 to the main intermittent drive shaft 79 involve chain or positive drive band connections which maintain the desired relative timing and rates of rotation of the various shafts without rotary slippage of any kind. Similarly, the feed bands 31 and 171 have appropriate interlocking driving engagement with driving drums 161 and 166 on shaft 79, so that the individual sheets can be fed longitudinally in exact desired registry for their moments of dwell at the printing units 34 and 36.

The positive driving connection is provided between feed bands 31 and 71 and their respective driving rollers 161 and 166 as illustrated in FIG. 1A. For this purpose drum 161 has equally spaced driving pins 244 which engage corresponding openings 246 in the feed band. Thus no relative slippage can take place between the bands and their respective driving rollers.

As also shown in FIG. 1A, each driving roller is provided with a recess 247, instead of a pin, at those points required to receive the screw or bolt heads, such as 172 and 202, by which each gripper device is firmly secured to its feed band, as well as the ends of locating pins 200 which orient the gripper devices on the bands and permit the bands to flex around the driving sprocket 161. In this embodiment, the drive pins are one inch apart, and each gripper device is secured to its band at a point where its screw head and locating pin will be received in a recess which replaces the normal driving pin at that location on the corresponding driving band.

The successive sheets are preferably fed and registered with the trailing edge of each leading sheet in exact abutting relationship to the leading edge of the following sheet. Thus the apparatus provides for the exact intermittent feeding of a plurality of successive individual sheets in a manner providing the advantages of exact registration as fully as they could be achieved by feeding a continuous sheet through the apparatus. The apparatus is particularly adapted to the processing of partially preprinted blanks, each of which includes a plurality of bank checks, on which certain amounts of preprinting can be achieved in known manner with the existing apparatus, without the necessity of trying to design a more complex apparatus for performing both preliminary and further printing steps on a single continuous sheet. The invention thus provides the advantages of batch processing in the preparation of the individual sets of partially preprinted check blanks, each of which includes a plurality of individual check areas, while providing the advantages of a rapid intermittent final printing process at high intermittent speeds and under carefully and electronically controlled conditions which can readily change the matter to be printed on each successive batch of sheets. The term "check blanks" is illustrative, since the present apparatus can be used with other bank or business forms for which similar processing would be desirable.

Sheet Discharging Mechanism

As described in connection with FIGS. 1 and 7, the individual printed sheets, following their printing operations at printing stations 34 and 36, are released by the grippers from their intermittent feeding action as the sheets approach the discharge end of the machine. The location of the grip release can portion 223, 224 is such that the grippers are released just as the leading edge of each sheet is ready for engagement between a continuously and rapidly rotating discharge roller 250 on driven shaft 86 and cooperating idler rollers 251 carried by a cross shaft 252 at the end of a lever arm 253, as shown particularly in FIG. 9. An upwardly projecting lever arm 255 on member 253 has a connection at 256 for one end of a spring member 257, the other end of which is secured at 258 to a side frame member. Spring 257 thus urges rollers 251 into firm driving engagement with the upper surface of the sheet which passes between the driving rollers and the idler rollers 251.

A series of longitudinally extending guide fingers 259 are supported on a cross shaft 261 to engage the top surfaces of the individual sheets as they move from the rapidly rotating discharge rollers 250 to a second set of discharge rollers. Thus the discharge ends 262 of guide fingers 259 extend substantially to the space just ahead of the correspondingly rotating discharge rollers 263 on driven cross shaft 83 (FIG. 8). Another set of idler rollers 264 is carried by a cross shaft 266 at the lower end of angular supporting arms 267 carried by another cross shaft 268 in the frame. The two sets of discharge feed rollers 250 and 263 rotate at essentially the same high speed, and their rate of rotation is designed to move each individual sheet rapidly away from the following sheet at the end of the intermittent feeding and printing operation.

The individual sheets discharged from the final rollers 263 and 264 can be directed in either of two directions by a suitable guide plate carried by a transverse shaft 269. This guide plate 271 may be swung between the two positions shown in FIG. 8 either to divert a given sheet upwardly for receipt by an inspection tray or to permit the sheet to drop downwardly onto the top of the discharge stack 38. Plate 271 has notched areas 272 which permit the plate 271 to swing above or below the inlet ramp 279 of the inspection tray 281. The swinging movement of diverter plate 271 between the two positions shown in FIG. 8 is controlled by a lever arm 273 at one end of shaft 269. Lever arm 273 is engaged by the longitudinally movable shaft 274 connected to the armature of a solenoid 276. Solenoid 276 has leads 277 and 278 which may either be connected for automatic control by the computer 41 (FIG. 2) or which can be connected for manual operation. The plate 271 can be moved to the position in which it feeds a given sheet upwardly to the inspection tray 281 either to check the accuracy of the printing on the first sample sheet of a given run, or for some other purpose. When the solenoid core and lever arm 273 are in the left-hand position of FIG. 8, however, plate 271 will be above the sheets being discharged from rollers 263 and 264, so that such sheets can drop to stack 38.

The discharge stack of printed sheets is carried by a table or receptacle bottom plate 282 which, in turn, is connected by vertical supporting flanges 283 to cross bars 284 and 286. These cross bars are mounted for vertical sliding movement on vertical posts 287 fixed brackets 288 to the end frame of the machine.

The vertical positions of the supporting table 282 for the discharge stack are preferably controlled by a combination of hydraulic and air cylinders in known manner. As shown in FIG. 1, one such cylinder 289 extends vertically from a base member on the frame and has an internal position with a piston rod 290 extending upwardly and connected to the bottom of a cross frame member such as 284. Suitable fluid connections 291 and 292 are provided. Support 91 for the supply stack 28 may be similarly controlled as needed or desired to maintain appropriate vertical positions for the supply stack.

Printing Mechanism

The specific details of the printing mechanism used at printing heads 34 and 36 of the machine disclosed herein do not form a part of the present invention. Commercially available printing mechanisms can be used or adapted for combination in the present apparatus.

For such combination according to the present invention, the printing units 34 and 36 are mounted and interconnected in a particularly advantageous manner. Printer 34 has a bottom support frame member 351 with a downwardly projecting support flange 352 connected to a supporting sleeve 353 at the "upstream" side of the printing unit. A similar flange 354 is connected between frame 351 and a supporting sleeve 356. The supporting sleeves 353 and 356 are slidably mounted on a longitudinally extending support shaft 357 carried by brackets 358 in the machine frame.

The unit 34 can be selectively located at a desired relative longitudinal position along the path of intermittent feed of the sheet to be printed by providing suitable locking stops 359 and 361 at opposite ends of sliding bracket 353 and by further providing similar locking members 362 and 363 at each end of the sleeve 356. The respective locking sleeves may be provided with locking or set screws in known manner and can be released to permit longitudinal adjustment of the position of printing unit 34 and then tightened to secure the unit at its desired relative longitudinal location.

The second printing uint 36 is supported in similar fashion, with its bottom supporting plate 351 provided with depending flanges 352A and 354A secured to sliding tubular bearing portions similar to those of unit 34. Adjustable locking members 359A, 361A, 362A and 363A similarly provide for selective adjustment of the position of printing unit 36 along the fixed longitudinal supporting shaft 357.

To adjust the relative spacing between the units, a micrometer type of connection 364 is provided. This connection includes connecting shaft portions 366 for unit 34 and 367 for unit 36. By rotation of the knurled adjusting knob portion, the relative longitudinal spacing between the printing units 34 and 36 can be adjusted as needed or desired to insure proper registration of characters or legends printed by the second unit 36 with respect to the characters or legends printed by the first printing unit 34.

Each printing unit includes a plurality of printing bands or drums 371 which are rapidly rotatable to the desired selected character for a given portion of the area to be printed. Below the printing drum characters 371 and the top of the sheets to be printed, a suitable inking band 372 can be fed. Such a band moves between supply and take-up rolls 373 and 374 over suitable intermediate idler members so that a fresh portion of the inking ribbon can be used at each intermittent printing operation. The actual printing impact is obtained by appropriate vertically movable printing hammers 376 which momentarily strike the bottom of the sheet to be printed and force it upwardly against the inking band 372 and type members 371. As previously described, the printing operation takes place rapidly at an instant when the intermittent feed mechanism is stationary and thus provides a momentary dwell for the sheets to be printed. As each printing impact is completed, the mechanism is timed to provide the intermittent feeding of each sheet for the desired longitudinal distance, such as the three inches required to accommodate sheets of partially preprinted bank checks which individually have lateral strips with a three-inch distance from top to bottom of each check, i.e., a three-inch distance longitudinally of the feed path in this machine.

To facilitate the adjustment of the individual longitudinal positions of the respective printing units 34 and 36, as well as their relative spacing from each other, the side plates of the machine 21, as illustrated in FIG. 1, may be left with an access opening at 377.

Once the printing units 34 and 36 are properly located longitudinally of the feed path, the complete assembly is ready for operation.

Timing Details

Figure 10:
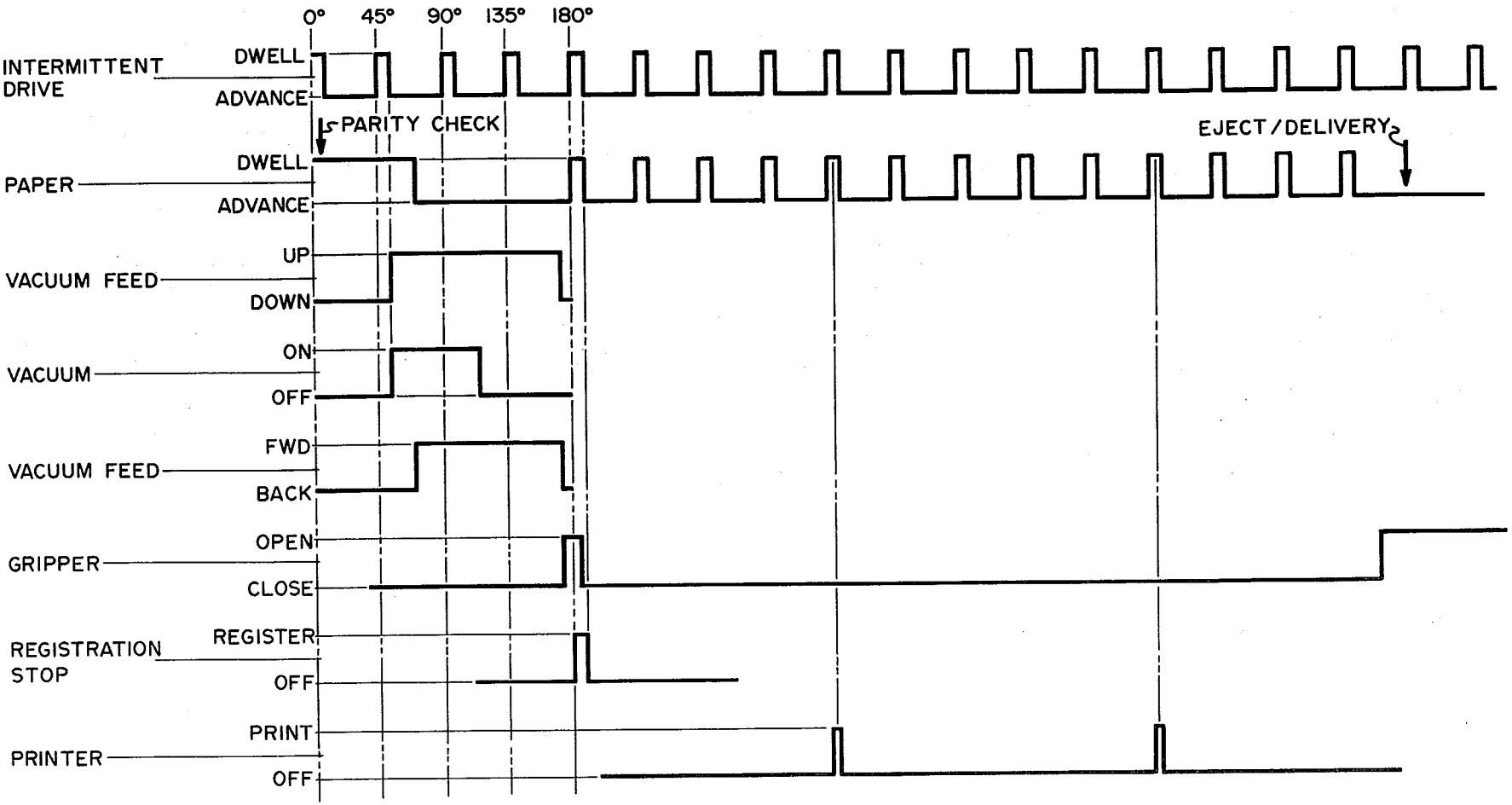
FIG. 10 is a timing diagram showing graphically the sequence of operation of major elements of the apparatus.

To facilitate the understanding of the present invention and the manner in which the various continually driven shafts and intermittently driven shafts cooperate with each other, a partial timing diagram is shown in FIG. 10. The upper line of this diagram indicates that the intermittent drive in this particular embodiment has moments of dwell, during which the feed bands, grippers and associated sheets to be printed are held stationary at intervals representing each 45 degrees of rotation of the intermittent drive shaft 79. These points of dwell correspond, in the example described above, to longitudinal increments of travel of three inches each. The top line of the timing diagram indicates that this intermittent drive is continuous and repetitive throughout the operation of the machine.

The next line of the timing diagram indicates the relative movement of the individual sheet starting from the supply stack until it is ejected to the discharge rollers at the end of the machine. The paper remains stationary or in a "dwell" condition during the initial parity check by elements 51 and 52. Then, in response to the operations of the vacuum feed mechanism and application of vacuum as shown by the next three lines of the timing diagram, the top sheet is lifted and advanced to the feed rolls, and further by the feed rolls to the registration stop and grippers of the intermittent feed mechanism at the end of the first 180 degree rotation of the intermittent drive shaft 79. From that point the movements of the paper are intermittent as shown, corresponding to the movements of the intermittent drive, until the paper is pulled away by the discharge rollers 250 and 263.

The third line of the timing chart shows the up and down movements of the vacuum feeding head 107, as controlled by cam 123. The fourth line shows the points in the cycle at which suction is applied to the suction grippers 108.

The fifth line of the timing diagram shows the forward and backward movement of the vacuum feeding head 107, as controlled by cam 124. It will be understood that the sequence of operations shown in the second, third, fourth and fifth lines of the timing diagram for the corresponding 180 degree rotation of the intermittent drive shaft 79 are repeated in similar fashion during each such 180 degree rotation (which actually involves four intermittent advance periods for each such 180 degree cycle). For convenience, FIG. 10 is designed to show the progress through the machine of only a single sheet, although it will be understood that the same cycle is then started again and followed for each successive sheet at 180 degree intervals of the intermittent drive.

The sixth line of the timing diagram of FIG. 10 shows the points in the cycle at which the grippers for the leading edge of each sheet (which grippers are normally held resiliently in closed position) are opened. The grippers are initially opened by cam 234 just before the 180 degree dwell point of the diagram to let the leading edge of a sheet register against the registration stops such as 231. The grippers are then closed just before the dwell period ends. They are again opened after the printing cycle is complete, in response to the engagement of stationary cam surfaces 223, 224, just before the sheet is picked up by the discharge feed rolls and removed from the intermittent feed section.

The seventh line of the timing diagram shows the dwell period for the registration stop at the 180 degree point. It will be understood that the opposite registration stop would come into receiving position at the end of the next 180 degree cycle, and that the stop for which the registration position is shown in the timing diagram would again be in stationary registration position at intervals of 360 degrees from the first registration point shown in FIG. 10.

The final line of the timing diagram of FIG. 10 shows the points in the cycle at which the respective printers 34 and 36 are triggered during corresponding momentary dwell or stationary points in the intermittent movement of the sheets to be printed.

As indicated by this timing diagram and by the detailed foregoing description, certain functions are controlled by the intermittent drive 79 itself, while other functions, particularly the operations of the initial sheet supply mechanism, the initial opening of the grippers at the registration point, and the movement of the guide plate 241 are controlled by continuously rotating shafts or cams from the continuous drive shaft 68.

As described, the present invention is particularly useful for the final printing of bank check blanks on which certain portions have been previously preprinted. Accurate registration of printed characters such as the MICR printing on such bank checks and the like is essential to the proper error-free handling of such documents by the automatic reading and data processing equipment now widely used in commercial banking operations. The present apparatus provides for such accuracy by first registering each sheet accurately along an intermittently driven feed at a location ahead of the printing position, firmly gripping each sheet in its registered position on the feed band, and then moving the feed band and sheet as a unit, by precise intermittent movements of the feed band, to the accurately predetermined printing position at which each desired printing unit has been located and adjusted. The intermittent drive provides exact increments of movement to control the accurate positioning of each sheet at the printing positions.

The foregoing specification sets forth certain preferred embodiments and modifications of the invention and some of the ways in which the invention may be put into practice, including the best mode presently contemplated for carrying out this invention. Modifications of the described embodiment, as well as alternate embodiments and devices for carrying out the invention may also be apparent to those skilled in the art, within the spirit and scope of the following claims:

I claim:

1. In a sheet feeding, registering and printing apparatus comprising a bed and platen printing unit with radidly and selectively adjustable printing elements within a defined printing position for printing selected characters on a desired printing area of a sheet having a leading edge and lateral side edge portions, when the printing area of such sheet is positioned close to such printing elements in such printing position, and means for feeding such a sheet longitudinally to and through the printing position with the printing area positioned close to and in desired registration with respect to the printing elements of the printing unit, the improved combination in which the feeding means comprises a feed band for feeding successive sheets from a registration position to and beyond the printing position, said feed band having at least one gripper device secured thereon for positive gripping and driving engagement with a lateral edge portion of each unit sheet, means guiding the band and gripper device for longitudinal movement along an axis spaced laterally from the printing elements at the printing position, intermittent driving means for positively driving the feed band and sheet in equal incremental movements from the registration position to and beyond the printing position, initial sheet supply mechanism for feeding successive separate individual sheets to the feed band and gripper device, and registration means for sequentially positioning a lateral edge of such sheet in accurate longitudinal and lateral registration with the feed band and gripper device at the registration position.

2. Apparatus according to claim 1 in which the sheet feeding means includes means interconnecting and driving the initial sheet supply mechanism and the registration means in timed relation to each other, means including such interconnecting and driving means and the relative spacing, orientation and location of the supply mechanism and registration means for feeding the leading edge of each following sheet into accurate edge-to-edge registration with the trailing edge of its immediately proceding sheet, and means interconnecting and driving the feed band and gripper device in timed relation to the sheet supply mechanism and registration means for maintaining the sheets in such edge-to-edge position as they move intermittently to and beyond the printing position.

3. Apparatus according to claim 1 in which the relative lengths of each sheet and of each incremental movement of the feed band provide a specified plurality of incremental movements and intermediate stationary dwell positions for each sheet as such sheet moves through the printing position.

4. Apparatus according to claim 3 in which the initial sheet supply mechanism includes continuously driven supply control and feeding shafts driven in timed sequence to feed one sheet to the intermittently driven feed band and gripper device for each specific plurality of incremental movements of the band.

5. Apparatus according to claim 3 having means for actuating the printing unit and printing desired characters at one location on each sheet while such sheet is in one dwell position at the printing position and for actuating the printing unit and printing desired characters at another location on the same sheet while such sheet is in another dwell position at the same printing position.

6. Apparatus according to claim 1 in which the intermittent driving means includes an intermittently driven transverse drive shaft, a first sprocket supported for rotation on a transverse axis and having a peripheral surface supporting one end of the feed band ahead of the printing position, a second sprocket supported for rotation on a transverse axis beyond the printing position with the feed band extending longitudinally past the printing position in a continuous loop around the first and second sprockets and with one run of the feed band located to carry a lateral edge portion of each sheet past the printing position, one of said sprockets constituting a driving sprocket connected to said transverse drive shaft, interengaging means on the feed band and at least the driving sprocket providing positive, nonslipping driving engagement between such band and sprocket, the circumference of said first sprocket corresponding to a selected multiple of the lengths of the individual sheets to be carried by said sprocket and feed band, and said registration means including at least one radially projecting registration stop fixed to rotate with the first sprocket and projecting upwardly above the feed band for engagement at a specific transverse location above said first sprocket axis by a leading edge portion of a sheet fed from the initial sheet supply mechanism while the drive shaft is momentarily at rest at the end of one of its incremental movements, the number of said radial registration stops around the first sprocket axis at said transverse location corresponding to the selected multiple of the sheet lengths around the circumference of the sprocket.

7. Apparatus according to claim 6 in which the feeding means has two transversely spaced feed bands with gripping devices on the respective bands for engaging opposite sides of the leading edge portions of each sheet and moving the sheet intermittently along a path between and defined by the feed bands, the registration means including at least two sets of registration stops, one of which has its transverse location spaced inwardly from one feed band and the other of which has its transverse location spaced inwardly from the other feed band, each such set having its individual stops transversely opposite to each other and thereby defining an exact registration position for the leading edge of each sheet for engagement by the gripping devices at a predetermined location along the feed path.

8. Apparatus according to claim 7 in which the initial sheet supply mechanism includes transverse lower and upper continuously rotating feed rollers for initially and firmly gripping a sheet between them and driving it longitudinally to engage its leading edge against the registration stops at registration position, the distance between the feed rollers and registration stops while the stops are briefly in their registration position being slightly less than the length of a single sheet and thereby providing means for slight vertical flexing of a portion of each sheet when its trailing edge has passed through the feed rollers and its leading edge engages the registration stops at said registration position.

9. Apparatus according to claim 1 in which the feeding means has two of said feed bands transversely spaced from each other with at least one gripper device on each of the respective bands for engaging opposite lateral edge portions of each sheet and moving such sheet intermittently along a longitudinal path between the feed bands, means guiding each of the respective feed bands and their associated gripper devices for longitudinal movement along respective axes spaced laterally from the printing elements at the printing position and at opposite sides thereof, thereby holding each such sheet firmly by its lateral edge portions with its desired printing area in the desired registration close to the printing elements of the printing unit when the intermittent driving means momentarily stops the feed bands between two of such incremental movements.

10. Apparatus according to claim 1 in which the registration means includes at least one registration stop movably supported at the registration position, moving means selectively moving such stop in timed relation into the path of the leading edge of a sheet being fed from the initial sheet supply mechanism and establishing the relative longitudinal position of such leading edge at the registration position when the intermittent driving means momentarily stops the feed band with a gripper device at the registration position and before such gripper device engages a lateral edge portion of the sheet, and said moving means selectively moving such stop out of the path of such leading edge when the gripper device has engaged such lateral edge portion and the intermittent driving means moves such feed band, gripper device and sheet longitudinally away from the registration position toward the printing position.

11. Apparatus according to claim 9 having a sprocket supported for rotation on a transverse axis at the registration position, interengaging means on the feed band and sprocket providing positive, non-slipping engagement between such band and sprocket, and said registration stop being supported and connected for common intermittent rotation with said sprocket on the same transverse axis, and with such stop projecting radially beyond the sprocket and feed band for engagement and longitudinal registration of the leading edge of a sheet being fed from the initial sheet supply mechanism.

12. Apparatus according to claim 9 in which one gripper device is secured on the feed band at a relative longitudinal location corresponding generally to the longitudinal location of the registration stop when the gripper device is stopped momentarily at the registration position for gripping the lateral edge portion of a sheet which is fed into the registration position against the stop, the gripper device including a gripper member resiliently biased to normally engage such a lateral edge portion and hold it in registration along the band, said gripper device having a cam follower portion movable to open the gripper member against its resilient bias, and cam means for momentarily engaging the gripper cam follower and opening the gripper member as the leading edge of a sheet is fed from the initial sheet supply mechanism forwardly to the registration position against the registration stop.

13. In a sheet feeding, registering and printing apparatus having a printing unit for printing desired characters on a sheet, and means for feeding such a sheet to and from a printing position with respect to the printing unit, the improved combination in which the feeding means comprises a feed band having at least one gripper device secured thereon for positive gripping and driving engagement with each such sheet, intermittent driving means for positively driving the feed band in equal incremental movements to and beyond the printing position, initial sheet supply mechanism for feeding successive sheets to the feed band and gripper device, and registration means for sequentially positioning a leading edge of each sheet in accurate registration with the feed band, in which the intermittent driving means includes an intermittently driven transverse drive shaft, a driving sprocket fixed to said shaft and having a peripheral surface supporting one end of the feed band ahead of the printing position, an idler sprocket supported for rotation on a transverse axis beyond the printing position with the feed band extending longitudinally through the printing position in a continuous loop around the driving and idler sprockets and with the upper run of the feed band located to carry an edge portion of each sheet through the printing position, interengaging means on the feed band and at least the driving sprocket providing positive, nonslipping driving engagement between such band and sprocket, the circumference of said driving sprocket corresponding to a selected multiple of the lengths of the individual sheets to be carried by said sprocket and feed band, said registration means including at least one radially projecting registration stop fixed to the intermittent transverse drive shaft and projecting upwardly above the feed band for engagement at a specific transverse location above said shaft by a leading edge portion of a sheet fed from the initial sheet supply mechanism while the drive shaft is momentarily at rest between two of its incremental movements, the number of said radial registration stops around the intermittent drive shaft at said transverse location corresponding to the selected multiple of the sheet lengths around the circumference of the driving sprocket, and in which one gripper device is secured on the feed band at a longitudinal location corresponding to each registration stop, the gripper device including a gripper member above the band, resiliently biased to normally engage a sheet edge and hold it in registration along the band, said gripper device having a cam follower portion movable to open the gripper member against its resilient bias, and cam means for momentarily engaging the gripper cam follower and opening the gripper member as the leading edge of a sheet is fed from the initial sheet supply mechanism forwardly to a registration position against the registration stop.

14. Apparatus according to claim 13 having further cam means positioned beyond the printing position for engaging each gripper cam follower and opening the gripper member after each sheet has been printed at the printing position.

15. Apparatus according to claim 14 in which the further cam means includes a longitudinal cam surface above the feed band run and the gripper cam follower comprises an upwardly projecting arm engaging the cam surface and opening the gripper member in response to movement of the gripping device by the feed band beyond the printing position.

16. Apparatus according to claim 15 having a discharge roller supported for rotation on a transverse axis beyond the feed band at a location receiving and engaging the leading edge of each sheet as such sheet is released by opening of the gripper member.

17. Apparatus according to claim 16 having a second similar discharge roller positioned longitudinally beyond the first such roller, first and second idler rollers holding each sheet successively in engagement with the respective discharge rollers, guide fingers resiliently biased against the upper surface of each sheet and extending longitudinally between said discharge rollers, a discharge receptacle into which successive sheets are normally discharged as they are discharged from the second discharge roller, a generally horizontal guide plate pivotally supported for rotation on a transverse axis beyond the second discharge roller and having a vertically swingable edge extending rearwardly toward said discharge roller, and means for selectively swinging said guide plate and edge between a normal upper position in which it is spaced above the path of a discharged sheet for normal movement of the sheet from the discharge rollers to the discharge receptacle and a lower diverting position in which the guide plate and edge intercept a selected sheet leaving the discharge rollers and direct such sheet away from the discharge receptacle.

18. In a sheet feeding, registering and printing apparatus having a printing unit for printing desired characters on a sheet, and means for feeding such a sheet to and from a printing position with respect to the printing unit, the improved combination in which the feeding means comprises a feed band having at least one gripper device secured thereon for positive gripping and driving engagement with each such sheet, intermittent driving means for positively driving the feed band in equal incremental movements to and beyond the printing position, initial sheet supply mechanism for feeding successive sheets to the feed band and gripper device, and registration means for sequentially positioning a leading edge of each sheet in accurate registration with the feed band, and in which the feeding means has two of said feed bands transversely spaced from each other with gripping devices on the respective bands for engaging opposite sides of the leading edge portions of each sheet and moving the sheet intermittently along a longitudinal path between the feed bands, first guide means guiding one of said feed bands and its gripping devices at all times along a desired registration path at the corresponding sheet edge, second guide means guiding the other of said feed bands and its gripping devices along a nearly parallel second path at the opposite sheet edge, but with said second guide means diverging slightly from the first guide means and thereby holding each sheet laterally flat throughout its movement through the printing position.

19. Apparatus according to claim 18 in which all the gripping devices have sheet engaging surfaces which tightly grip the sheet edges in longitudinally nonslipping engagement during the intermittent feeding movements of each band, the sheet engaging surfaces of the gripping devices on said one feed band having longitudinal sheet-engaging ridges holding the corresponding sheet edge against transverse displacement from its registration path, and the sheet-engaging surfaces of the gripping devices on the other feed band having laterally smooth sheet-engaging surfaces permitting slight transverse relative movement of such gripping devices as they diverge from the registration path along which the registration edge of each sheet is guided.

20. Apparatus according to claim 18 having a support for the printing unit, interengaging support elements on the printing unit and on its support providing selective longitudinal adjustment of the printing unit along the support on a line exactly parallel to the desired registration path established by the first guide means.

21. Apparatus according to claim 20 having a second printing unit, said second unit and said printing unit support also having interengaging support elements providing selective longitudinal adjustment of the second printing unit along the support on a line exactly parallel to the desired registration path established by the first guide means and at a location spaced longitudinally from the first printing element, and a longitudinally adjustable connection element having respective portions connected to the two printing units for selective adjustment of the longitudinal spacing between the printing units.

22. Apparatus according to claim 21 in which the two printing units have respective printing elements which print desired characters on the successive sheets at desired areas during selected moments of dwell in which the feed bands are briefly stationary between the equal incremental movements of the feed bands, gripping devices and sheets and in which the respective printing elements of the two printing units are spaced longitudinally a distance equal to a selected plurality of the equal intermittent movements of the sheets, which plurality is greater than the number of such intermittent movements required for complete movement of a given sheet past either of the printing units.

23. In a sheet feeding, registering and printing apparatus comprising a printing unit with rapidly and selectively adjustable printing elements and cooperating printing hammers within a defined printing position for printing selected characters on a desired printing area of a sheet having a leading edge and lateral side edge portions, when the printing area of such sheet is positioned between such printing elements and hammers in such printing position, and means for feeding such a sheet longitudinally to and through the printing position with the printing area positioned close to and in desired registration with respect to the printing elements and hammers of the printing unit, the improvement in which the feeding means comprises two continuous-loop transversely-spaced substantially inextensible feed bands for feeding successive sheets from a registration position to and beyond the printing position, said feed bands having gripper devices thereon for positively and releasably engaging and gripping opposite lateral edge portions of each sheet and moving the sheet along a longitudinal path extending between the feed bands from the registration position to the printing position with the feed bands and gripper devices spaced laterally at opposite sides of the printing elements at the printing position, intermittent driving means for positively and rapidly indexing the feed bands and sheets in equal incremental movements with momentary intermediate stationary dwell positions from the registration position to and beyond the printing position at a rate substantially in the range of at least 340 three-inch incremental movements per minute, a plurality of such incremental movements being required to move an individual sheet through the printing position, said intermittent driving means including an intermittently driven transverse drive shaft at the registration position having laterally spaced driving sprockets secured thereon, each of which has a peripheral surface supporting a corresponding feed band, interengaging means on each feed band and its driving sprocket providing postive, nonslipping driving engagement between such sprocket and band, the apparatus further comprising registration means for sequentially positioning the lateral edge portions of each sheet in accurate longitudinal and lateral registration with the feed bands and gripper devices at the registration station, and initial sheet supply mechanism for feeding successive separate individual sheets to the feed bands and gripper devices at the registration position; the registration means comprising at least two sets of registration stops at transverse locations spaced inwardly from the respective feed bands at the registration station, each set including at least one radially projecting rotary registration stop fixed to the intermittent transverse drive shaft and projecting radially and vertically beyond the shaft and the feed band for engagement by a leading edge portion of a sheet as the drive shaft comes momentarily to rest after one of its incremental indexing movements, and means for momentarily opening a corresponding gripper device on each feed band to receive the lateral edge portions at each side of the sheet as the leading edge of the sheet is fed forwardly from the initial sheet supply mechanism to registration position against the registration stops; and the initial sheet supply mechanism including cooperating feed and gripper rollers continuously rotating on vertically spaced shafts extending transversely of the sheet path ahead of the registration position for driving each sheet forwardly to register its leading edge against the registration stops at the registration position, a support for a supply stack of sheets to be printed, and transfer means for moving successive sheets from the stack to the feed and gripper rollers in proper times sequence to reach the registration stops as the stops come to registration position.

24. Apparatus according to claim 23 in which the registration means includes a downwardly and forwardly extending transverse blade member having a forward edge extending transversely across the registration station just ahead of the registration position of the registration stops, said blade member being supported for movement of its forward edge between a registration position close to the sheet feed path, in which the blade edge prevents the leading edge of a sheet from overrunning the registration stops, and a retracted position, in which the blade edge is out of the way of the rotary registration stops and out of possible undesired contact with the sheets, and means for moving the blade member to and from its registration position in timed relation to the movement of the registration stops.

* * * * *

UNITED STATES PATENT OFFICE
CERTIFICATE OF CORRECTION

PATENT NO. : 4,220,081

DATED : September 2, 1980

INVENTOR(S) : Warren S. Hawkinson

It is certified that error appears in the above-identified patent and that said Letters Patent are hereby corrected as shown below:

Col. 3, line 35, "stripper" should read "gripper". Col. 6, line 50, "comcially" should read "commercially"; line 63, "shafts"should read "sheets". Col. 12, line 7, "and" (second occurrence) should read "the"; line 56, "such" should read "each". Col. 13, line 14, "by" (first occurrence) should read "be"; line 62, "to" should read "to a". Col. 14, line 29, "71" should read "171"; line 58, "the" should be deleted. Col. 16, line 48, "uint" should read "unit". Col. 17, line 50, "the" should read "an". Col. 19, line 16-17, "radidly" should read "rapidly"; line 32, "unit" should read "such"; line 42, insert "each" after "of"; line 54, "proceding" should read "preceding". Col. 21, lines 36 and 48, the claim reference numeral "9" should read "10". Col. 26, line 6, "times" should read "timed".

Signed and Sealed this

*Ninth* Day of *December 1980*

[SEAL]

*Attest:*

SIDNEY A. DIAMOND

*Attesting Officer*

*Commissioner of Patents and Trademarks*